United States Patent [19]

Furtek

[11] Patent Number: 4,659,906

[45] **Date of Patent: * Apr. 21, 1987**

[54] INFRARED PANEL EMITTER AND METHOD OF PRODUCING THE SAME

[75] Inventor: Edward J. Furtek, East Kingston, N.H.

[73] Assignee: Vitronics Corporation, Newmarket, N.H.

[ * ] Notice: The portion of the term of this patent subsequent to Jul. 22, 2003 has been disclaimed.

[21] Appl. No.: 750,893

[22] Filed: Jul. 1, 1985

Related U.S. Application Data

[63] Continuation-in-part of Ser. No. 572,362, Jan. 20, 1985, Pat. No. 4,602,238.

[51] Int. Cl.[4] ..... H05B 3/68

[52] U.S. Cl. ..... 219/345; 29/611; 219/553; 338/252; 338/254

[58] Field of Search ..... 29/611, 613, 614, 615; 219/520, 538, 345, 353, 354, 355, 542, 552, 553; 250/495.1; 338/232, 249, 251, 254

[56] References Cited

U.S. PATENT DOCUMENTS

| | | | |
|---|---|---|---|
| 11,303 | 2/1893 | Morford | 29/613 |
| 2,158,600 | 5/1939 | Wiegand | 29/615 |
| 2,284,078 | 5/1942 | Wiegand | 29/615 |
| 2,504,146 | 4/1950 | Mossin | 338/254 |
| 2,513,993 | 7/1950 | Burton | 338/254 |
| 2,770,704 | 11/1956 | Razlag | 219/354 |
| 2,889,439 | 6/1959 | Musgrave | 219/354 |
| 3,031,739 | 5/1962 | Boggs | 29/613 |
| 3,060,300 | 10/1962 | Horner | 219/34 |
| 3,146,340 | 8/1964 | Dewey et al. | 219/520 |
| 3,160,736 | 12/1964 | Catterson | 219/520 |
| 3,495,328 | 2/1970 | Ziver | 29/611 |
| 3,567,906 | 3/1971 | Hurko | 219/542 |
| 3,596,351 | 8/1971 | Tilton et al. | 29/611 |
| 3,697,728 | 10/1972 | Stirzenbecher | 219/548 |
| 3,869,596 | 3/1975 | Howie | 219/345 |
| 4,310,745 | 1/1982 | Bender | 219/538 |
| 4,542,268 | 9/1985 | Jarvis et al. | 219/345 |

*Primary Examiner*—John H. Newsome

*Attorney, Agent, or Firm*—Wolf, Greenfield & Sacks

[57] ABSTRACT

A nonfocused infrared panel emitter and method of making the same. The panel emitter includes a primary emitter positioned between an insulating layer and a secondary emitter. Preferably, the primary emitter comprises a metal foil having a pattern formed by etching. The secondary emitter may be either a woven alumina cloth, or a sheet of glass which is transparent to infrared radiation. In one embodiment of the invention, a layer of somewhat compressible, high temperature resistant paper is placed on either side of the metal foil to accommodate expansion and contraction thereof. In one method of making the panel emitter, a mesh sheet is positioned adjacent the metal foil and the sheet is vaporized by heating to create a void adjacent the foil to allow for thermal expansion and contraction of the foil.

11 Claims, 6 Drawing Figures

INFRARED PANEL EMITTER AND METHOD OF PRODUCING THE SAME

CROSS REFERENCE TO RELATED APPLICATION

This application is a continuation-in-part of co-pending application Ser. No. 572,362 filed Jan. 20, 1985 now U.S. Pat. No. 4,602,238.

FIELD OF THE INVENTION

This invention relates to a nonfocused infrared panel emitter and to a method of producing the same.

BACKGROUND OF THE INVENTION

Infrared radiation is that portion of the electro-magnetic spectrum between visible light (0.72 microns ($\mu$)) and microwave (1000 $\mu$). The infrared region is subdivided into near infrared (0.72–1.5 $\mu$), middle infrared (1.5–5.6 $\mu$), and far infrared (5.6–1000 $\mu$).

When an object passes in close proximity to an infrared source, infrared energy penetrates the material of that object and is absorbed by its molecules. The natural frequency of the molecules is increased, generating heat within the material, and the object becomes warm. Every material, depending upon its color and atomic structure, absorbs certain wavelengths of infrared radiation more readily than other wavelengths. Middle infrared is more readily absorbed by a greater number of materials than is the shorter wavelength near infrared radiation.

One type of infrared source is the "focused" emitter. This type emits a specific wavelength of infrared energy—usually in the near infrared region—which is a wavelength easily reflected and not readily absorbed by many materials. To compensate for this lack of penetration the intensity of such emitters is increased and reflectors are used to focus the emission on the process area. Increased intensity causes increased power consumption, hotter emitter operation requiring cooling systems, shorter emitter life, and damage to temperature-sensitive product loads which are being heated. Further, the condensation of process vapors on the reflector and emitter surfaces may cause a loss of intensity. Focused infrared sources generally require a substantial energy input, convert only 20 to 59% of the input energy to infrared radiation, and have a life expectancy of approximately 300 hours.

A well-known focused emitter is the T-3 lamp which consists of a sealed tubular quartz envelope enclosing a helically-wound tungsten filament (resistive element) supported by small tantalum discs. The tube is filled with an inert gas such as a halogen or argon to reduce oxidative degeneration of the filament. Due to the different thermal expansion coefficients of the quartz and the metal lead wires adequate cooling must be maintained at the seals or lamp failure will result. The T-3 lamp, when at rated voltage, operates at a peak wavelength of 1.15 with a corresponding filament temperature of 2246° C.

Another commonly used focused emitter is the Ni/Cr alloy quartz tube lamp which is similar to the T-3 lamp in construction except that the filament is contained in a non-evacuated quartz tube. This infrared source, when at rated voltage, operates at a peak wavelength of 2.11 with a corresponding filament temperature of 1100° C.

Nonfocused infrared panel emitters are available which operate on the secondary emission principle.

Panel emitters contain resistive elements which disperse their energy to surrounding materials which in turn radiate the infrared energy more uniformly over the entire process area and across a wider spectrum of colors and atomic structures.

The resistive element of such panel emitters is typically a coiled wire or crimped ribbon foil and is placed in continuous channels which extend back and forth across the area of the panel. The curved portions of the channels at each end of the panel area limit the proximity of the wire or foil in adjacent channels. As a result, this construction limits the coverage of the panel area by the resistive element to 65 to 70% and this limited coverage makes it difficult to obtain precise temperature uniformity across the panel emitting surface.

Another known panel emitter comprises a glass emitting layer coated with tin oxide which serves as the resistive element. The tin oxide layer is applied by an expensive vapor deposition process.

SUMMARY OF THE INVENTION

It is one object of this invention to provide an improved infrared panel emitter having a minimum temperature variation across the emitting surface, and a method for making the same.

Another object of the invention is to provide an improved panel emitter that can be manufactured easily and economically.

Still another object is to provide such a panel emitter having a low power consumption.

In one embodiment, the invention includes a nonfocused infrared panel emitter having a primary emitter which is a foil having an etched pattern and which is positioned between an insulating layer and a secondary emitter. The electrode pattern of the etched foil covers from about 60 to about 90% of the total foil area, and preferably from about 80 to about 90%. The temperature variation across the panel emitting surface is less than about 0.5° C.

In another embodiment, the invention includes a panel emitter consisting of a primary emitter, a secondary emitter, and an insulating layer bonded together by means of a binder, the binder, secondary emitter, and insulating layer all having small coefficients of thermal expansion which are substantially identical having preferably about 0.1% shrinkage at 1000° C. A void adjacent the primary emitter permits thermal expansion and contraction of the primary emitter.

In a further embodiment, the invention includes a panel emitter which comprises a primary emitter, a secondary emitter, a compressible layer of paper disposed on either side of the primary emitter, and an insulating layer disposed on the opposite side of the panel from the secondary emitter. The entire panel is held together mechanically without the use of a binder by a metal housing. Again, the coefficients of thermal expansion of all the materials are substantially identical. Thermal expansion and contraction of the primary emitter is in part accommodated by the compressible nature of the paper disposed on either side thereof.

In one method of producing the panel emitter of the invention, a primary emitter is attached to a mesh sheet to form a composite which is positioned adjacent an insulating layer. A slurry of a binder is applied to the composite and allowed to penetrate through to the insulating layer. The secondary emitter is then placed adjacent the composite to form an assembly. Additional slurry is applied to the emitting surface of the secondary emitter. The assembly is then heated at a low temperature (preferably below 250° C.) to dry the moisture out of the panel components. The assembly is heated to a temperature (preferably below 500° C.) to vaporize the mesh sheet and form the void for thermal expansion of the foil. The assembly is then heated to a higher temperature (preferably above 800° C.) to bond together the secondary emitter. The primary emitter, and the insulating layer. The bonded panel emits infrared wavelength radiation in the middle and far infrared regions.

In another method of producing the panel emitter of this invention, a metal housing is used, and the layers of the panel emitter are held together mechanically by pressure applied by metal clips. The primary emitter is again attached to a mesh sheet to form a composite. The panel is assembled by placing the insulating layer in the housing, laying a first layer of compressible paper thereover, placing the primary emitter with the mesh sheet in position on the first layer of paper, laying a second layer of paper on the primary emitter, placing the secondary emitter over the second layer of paper and clamping the layers together with clips. No binder is used in this embodiment, and the secondary emitter preferably is made of a rigid material, such as glass transparent to infrared and visible radiation. The assembly is heated to vaporize the mesh sheet to form a void adjacent the primary emitter.

Other objects and advantages of the invention will be more fully understood from the accompanying drawings and the following description of several illustrative embodiments and the following claims. It should be understood that terms such as "upper," "lower," "above," and "below" used herein are for convenience of description only, and are not used in any limiting sense.

DETAILED DESCRIPTION OF THE PREFERRED EMBODIMENTS

Figure 1:
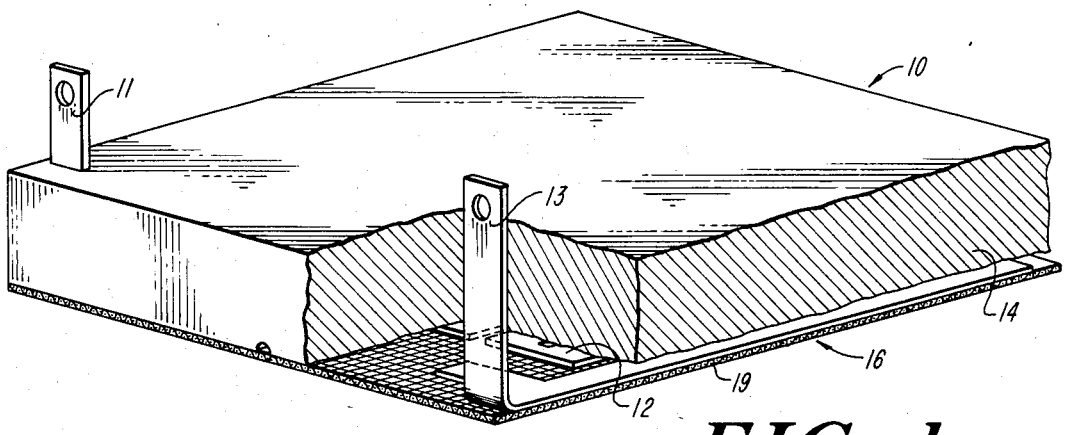
FIG. 1 is a perspective and partial sectional view of one embodiment of the panel emitter of the invention.

FIGS. 1–4 show an embodiment of the panel emitter 10 of this invention. Panel emitter 10 may be of any desired shape and is shown for illustrative purposes only as being rectangular. Panel emitter 10 includes a primary emitter 12 disposed below an insulating layer 14 and a secondary emitter 16 disposed below the primary emitter. The lower surface of the secondary emitter is the panel emitting surface 19.

Insulating layer 14 is electrically insulating and reflects infrared radiation to ensure efficient emission by the panel in one direction only, i.e., down in FIG. 1. An insulating layer of from about 0.5 inches to about 3 inches in thickness can be used. The material used for insulating layer 14 should be stable at high temperatures, and should be somewhat compressible to allow for expansion and contraction of primary emitter 12. It should also have the same coefficient of thermal expansion as secondary emitter 16, and not show any movement with heating. For high temperature use the insulating layer may be made of alumina and silica and may be in blanket or board form. One example of a material for insulating layer 14 is the 1.50 inch thick "hot board" made of alumina and silica, manufactured by the Carborundum Co., Niagara Falls, N.Y.

The primary emitter 12 is a resistive element and its resistance to the current passing through it causes it to heat and emit primary infrared radiation. The "primary" infrared radiation emitted by the primary emitter is absorbed by the secondary emitter 16, which causes the secondary emitter to be heated and emit "secondary" infrared radiation.

In a preferred embodiment, primary emitter 12 is a generally planar foil. The foil can be of any material having a high emmisivity factor, preferably greater than about 0.8, such as stainless steel. The foil should have a thickness of from about 0.0005 inch to about 0.005 inch. A preferred material is "Inconel" steel, made by United States Steel Corp., Pittsburgh, Pa., having an emmisivity factor of 0.9 and a thickness of 0.003 inch. Two terminals 11 and 13 having a thickness greater than the foil extend from the foil for connection to a current source. The terminals may extend through openings 15 and 17 in the insulating layer in (see FIGS. 1, 3, and 4).

The foil is preferably spaced from about 0.32 cm to about 1.27 cm from all edges of the panel so the foil is not exposed and will not short circuit. For example, in a 12×18 inch panel, the foil has an 11.5×17.5 inches dimension and thus a 0.5 inch margin at each edge. This margin is small enough so that the secondary emitter at the margins can absorb and emit sufficient radiation to keep the entire 18 inch×12 inch emitting surface at a uniform temperature.

Figure 2:
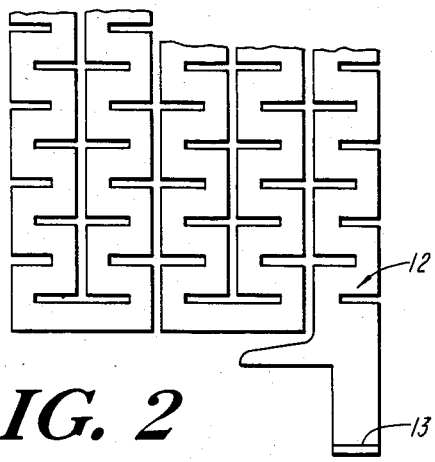
FIG. 2 is a partial plan view of the primary emitter of the panel emitter of the invention.

The foil pattern is created by etching and may be prepared by a known metal etching process. The pattern may cover from about 60 to about 90% of the total foil area depending upon the wattage at which the panel will operate. Preferably the pattern is very closely spaced as shown in FIG. 2 so as to cover at least about 80 to about 90% of the total area. The use of an etched foil permits the formation of a precise and closely spaced primary emitter configuration and permits greater panel area coverage than prior art emitters having metal strips which are bent or folded at each end of the panel.

In one embodiment of the invention, the primary emitter lies adjacent a very small void to permit thermal expansion and contraction of the primary emitter. This void is further described hereinafter in the method of making the panel emitter.

Secondary emitter 16 consists of an electrically insulating, high emissivity material having an emitting surface 19 for emitting secondary infrared radiation. In the embodiment of FIGS. 1–4, the secondary emitter 16 is a thin (of from about 0.032 inch to about 0.040 inch) sheet, having a low mass, and an emmisivity factor of greater than about 0.8. A woven alumina cloth made by 3M Co., St. Paul, Minn., consisting of 98% alumina and 2% organic material, approximately 0.039 inch thick, and having an emissivity factor of 0.9, is preferred. An alumina paper made by The Carborundum Co., Niagara Falls, N.Y., and having approximately the same composition and thickness is another suitable example. Other materials which may be used to make the insulating layer and secondary emitter include silicon rubber and fiberglass.

In the embodiment of FIGS. 1–4, an electrically-insulating binder having a high emissivity factor, preferably of greater than about 0.8, is applied in slurry form to the panel components to aid in bonding together the secondary emitter, the primary emitter, and the insulating layer, as described hereinafter. The binder may be alumina and silica and should contain at least 20% silica by total weight of the slurry. A preferred material is "QF180" sold by The Carborundum Co., Niagara Falls, N.Y., which in slurry form consists of 65% alumina, 25% silica and 10% water by total weight of the slurry. It is important that the coefficients of thermal expansion of the binder, the secondary emitter, and the insulating layer be nearly identical to prevent warping of the panel during bonding.

Figure 4:
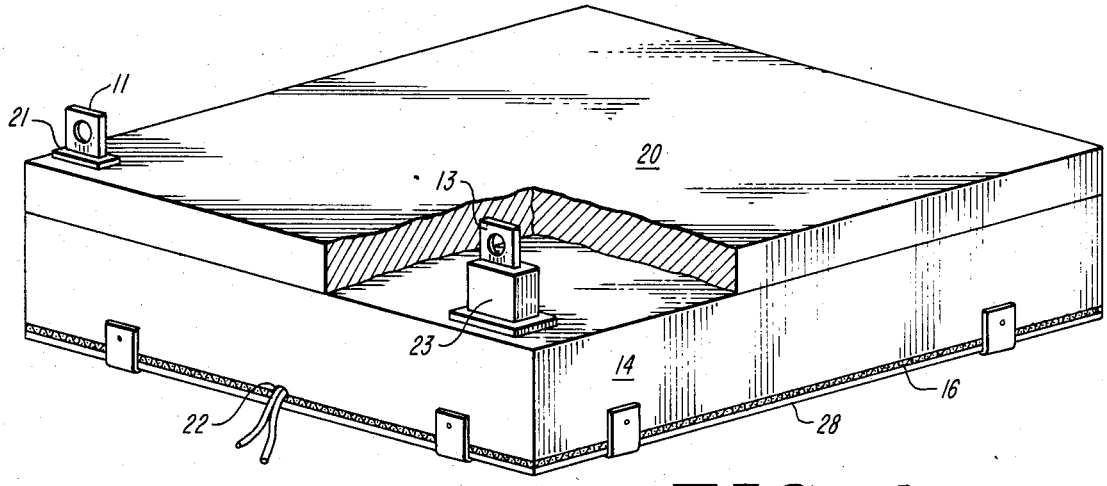
FIG. 4 is a perspective and partial sectional view of the panel emitter of FIG. 1 in a housing and connected to a thermocouple.

Another configuration of the first embodiment is shown in FIG. 4. To provide additional support the bonded panel may be disposed in a steel housing 20 by connecting the insulating layer 14 to the housing 20 with ceramic lugs 21 and 23. Further, a vicor glass plate 28 which is translucent to infrared radiation, may be applied over the emitting surface 19 to protect it from wear. A quartz tube containing a thermocouple 22 may be positioned in a channel in the insulating layer 14 and adjacent the primary emitter 12 for monitoring the temperature of the primary emitter 12. When a glass plate 28 is used, the interior of the panel is sealed to minimize atmospheric contamination thereof.

Figure 6:
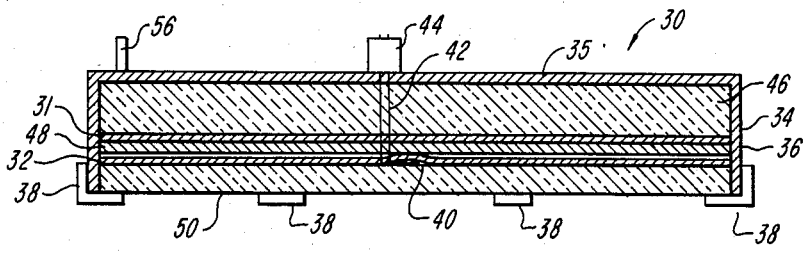
FIG. 6 is a cross-sectional view of the panel emitter of FIG. 5 when assembled.
Figure 5:
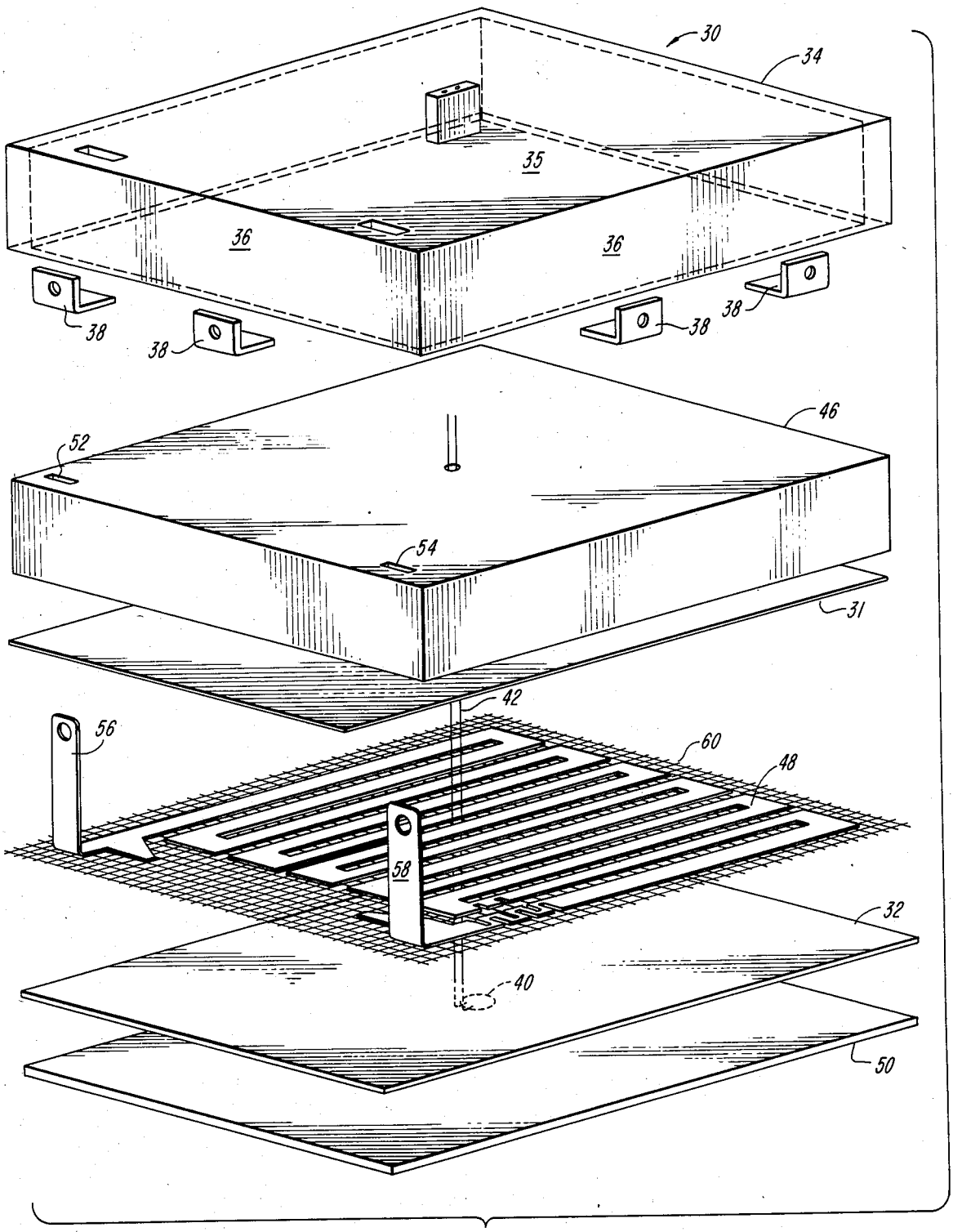
FIG. 5 is an exploded perspective view of the components used in an alternative embodiment of the panel emitter of the invention.

With reference to FIGS. 5 and 6, a second preferred emitter 30 of the present invention will be described. Emitter 30 includes insulating layer 46, primary emitter 48, paper sheets 31 and 32, secondary emitter 50 and housing 34. Primary emitter 48 is similar in every respect to primary emitter 12 and operates in the same manner. Primary emitter 48 is disposed between two sheets 31 and 32 of flexible, somewhat compressible paper which is highly stable at high temperatures. A typical example is a product which is formed of aluminum oxide ($Al_2O_3$) and silicon dioxide ($SiO_2$), which contains no binder, which is stable up to temperatures of about 1260° C. and which has a emissivity of about 0.9. An acceptable product is sold under the trademark FIBERFRAX 970 by Carborundum. A preferred thickness is about 0.015 inches.

In the embodiment of FIGS. 5 and 6, secondary emitter 50 should be a rigid material, which is transparent to both visible and infrared radiation.

In a preferred embodiment, secondary emitter 50 is made of a high temperature glass. A preferred composition is melted and fused zirconia and titania. Examples are PYROCERAM, manufactured by Corning Glass Works, and NEOCERAM, manufactured by Nippon Glass Works in Osaka, Japan. Both PYROCERAM and NEOCERAM have an emissivity of 0.9, and they transmit 90% infrared radiation in the wavelength 3.5 to 10.5 microns. Also, both materials are optically clear so that thermocouple 40 can be installed in front of the primary emitter 50 yet behind secondary emitter 50, allowing for a direct reading of the thermocouple 40. Both materials are stable up to temperatures of 750° C.

A preferred material for insulating layer 46 in the embodiment of FIGS. 5 and 6 is a material which is somewhat compressible, does not shrink under high temperature, is nonfibrous and has no binder, and does not change state. A preferred material is a calcium chloride powder which is compressed into a board form. A commercially available product which is suitable is manufactured by Johns Manville and is sold under the trademark THERMO 12.

As shown in FIGS. 5 and 6, the layers of this embodiment are held together mechanically by a metal housing 34 which has sidewalls 36 and a bottom wall 35. A plurality of clips 38, typically two per sidewall 36, are secured to sidewalls 36, such as by rivets, and overlie the edges of secondary emitter 50 to mechanically clamp the layers of the panel against bottom wall 35 to hold the layers in place. Housing 34 typically is composed of aluminum, steel or an aluminum steel alloy. Typically, the panel is held together by around 10 pounds of force applied by the clips 38 each side of the panel. This amount of force allows expansion of primary emitter 48 without interfering with its operation. A thermocouple 40 is provided between secondary emitter 50 and sheet 32, and a lead 42 extends through insulating layer 46, paper layer 30, and a gap in primary emitter 48. Lead 42 is adapted to be coupled to an exterior connection by connector 44 which resides on the outside surface of bottom wall 35. Thermocouple 40 is visible through secondary emitter 50 and is held in position by the tight spacing between sheet 32 and secondary emitter 50.

Paper sheets 30 and 32 hold primary emitter 48 in place mechanically as a result of the pressure applied to the layers by housing 34. However, paper sheets 30 and 32 are sufficiently further compressible that they are able to accommodate the expansion and contraction of primary emitter 48 as it is heated, and as it cools without stressing primary emitter 48 and without permitting curling or buckling thereof. Also, primary emitter 12 is held in position by slots 52 and 54 through which terminals 56 and 58 of primary emitter 48 extend. One advantage of this embodiment is that the thermocouple 40 can now be of the exposed type which is far more responsive to temperature changes than other types of thermocouples.

When the panels of FIGS. 5 and 6 are used in opposition, so that the secondary emitters face one another, the thermocouples 40 in each panel can react to each other, because secondary emitter 50 is optically clear, and because of the low thermal mass of the glass used in secondary emitter 50. The thermocouple units are located within 0.015 inch of the surface of secondary emitter 12 (the approximate thickness of paper sheet 32). When used in opposition, products to be heated passing between the panels often create a shadowing effect, and this shadowing effect can be sensed.

Figure 3:
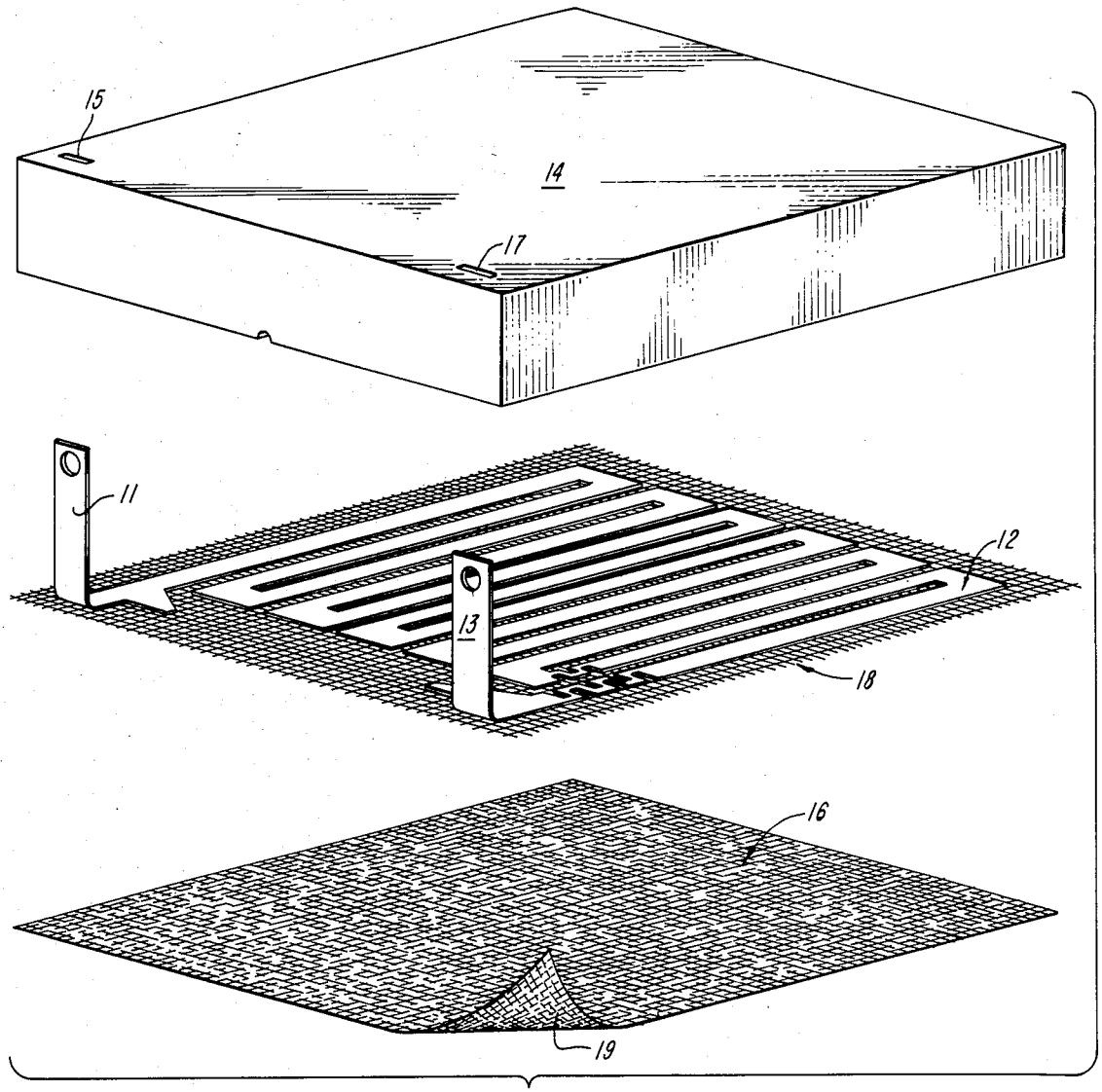
FIG. 3 is an exploded perspective view of the components used in one embodiment of the method of the invention.

With reference to FIG. 3, the method of making one embodiment of the panel emitter 10 of FIGS. 1–4 will now be described, (like numbers refer to like parts, where appropriate). Primary emitter 12, is placed adjacent one surface of a mesh sheet 18 to form a composite. Insulating layer 14 is placed adjacent one surface of the composite and the terminals 11 and 13 are inserted through the openings 15 and 17 in the insulating layer. Preferably, a coating of the binder slurry is applied, for example, by brushing, to the top of the composite and allowed to penetrate through the openings in the mesh sheet and through the openings in the primary emitter and into the insulating layer. The excess slurry is then squeegeed off. The binder, the secondary emitter, and the insulating layer have nearly identical coefficients of thermal expansion.

Secondary emitter 16 is placed adjacent the surface of the composite opposing the insulating layer to form an assembly. A coating of the binder slurry is applied to the emitting surface 19 of the secondary emitter and allowed to penetrate through the insulating layer. The excess slurry is squeegeed off. While two applications of the slurry is preferred, i.e., one to the composite and one to the assembly, it is sufficient to use only one application to the assembly so long as the slurry penetrates through to the insulating layer.

Mesh sheet 18 may be positioned either between the insulating layer 14 and the primary emitter 16 or between the primary emitter 12 and the secondary emitter 16. Typically, the primary emitter 12 is first attached to the mesh sheet 18 for example, by gluing, and the mesh sheet is positioned adjacent the secondary emitter.

The assembly is then heated slowly to a temperature and for a period of time to dry the moisture (from the slurry) out of the components, especially the insulating layer 14. For example, the assembly may be heated to a temperature of not more than about 150° C. for 60 minutes.

The assembly is then heated to a temperature and for a period of time to vaporize the mesh sheet 18, for reasons described hereinafter, and to vaporize the excess binder. For example, the assembly may be heated to a temperature below about 500° C. for 60 minutes.

The assembly is then heated to a temperature and for a period of time to bond together the secondary emitter 16, the primary emitter 12, and the insulating layer 14. By heating above about 800° C. and preferably at about 1000° C. for at least 60 minutes the silica in the binder vitrifies and bonds together the panel components to form a vitreous panel emitter. Further, depending upon how high a temperature is used, voids are eliminated within and between the insulating layer and the secondary emitter to form a sintered body.

The mesh sheet 18 may be formed of any material which vaporizes at a temperature less than the temperature at which the components of the panel are bonded together. The purpose of the mesh is to support the primary emitter 12 during processing and to create a small void between the secondary emitter 16 and insulating layer 14 to allow unrestricted thermal expansion and contraction by the primary emitter 12 in the bonded panel emitter. The mesh sheet 18 may be placed either between the primary emitter 12 and the secondary emitter 16 or between the insulating layer 14 and the primary emitter 12, preferably the former. The openings in the mesh allow the binder to penetrate through to the insulating layer 14 to aid in bonding. The mesh preferably has a thickness of from about 0.010 inch to about 0.030 inch, has openings of at least about 0.125 inch, and vaporizes at a temperature below about 350° C. A preferred material is a loosely woven nylon mesh approximately 0.015 mil thick which decomposes at approximately 350° C.

One embodiment of the panel emitter made according to the method of invention is shown in cross-section in FIG. 1. The secondary emitter 16 consists of a woven alumina cloth. An etched foil 12 lies adjacent the alumina cloth 16 and can expand and contract within the void (not shown) left by the mesh sheet between the insulating layer 14 and the alumina cloth 16. An alumina silica binder (not shown) bonds together the cloth, foil, and insulating layer.

The alumina cloth, alumina silica slurry, and alumina silica insulating layer are preferred, especially for use at high temperatures. The alumina content of the insulating layer and secondary emitter should be greater than about 70% by weight; the binder slurry should contain from about 20 to about 50% silica by total weight of the slurry to achieve a vitreous bond. The coefficients of thermal expansion of the alumina cloth, alumina silica binder, and the alumina silica insulating layer are small and substantially identical—namely, all about 0.1% shrinkage at 1000° C. Materials which shrink more than about 1% should not be used in the panel as it will warp during bonding.

A preferred method of assembling the panel emitter 30 of FIGS. 5 and 6 will now be described. Housing 34 is preformed in a known manner, typically from sheet metal. As with the embodiment of FIGS. 1–4, primary emitter 48 is mounted onto a mesh sheet 60 to form a composite. Mesh sheet 60 is identical in every respect to mesh sheet 18. Insulating layer 46 is first placed in housing 34 adjacent bottom wall 35. Sheet 31 is placed adjacent the exposed surface of insulating layer 46, and primary emitter 48 and mesh sheet 60 are inserted into housing 34. Mesh sheet 60 may be either placed adjacent sheet 31, or it may face sheet 32. Terminals 56 and 58 are inserted through slots 52 and 54 in insulating layer 46 and then through corresponding slots in housing 34. Mesh sheet 32 then is placed into housing 34 over the composite formed of primary emitter 48 and mesh sheet 60. Thermocouple 40 is placed adjacent sheet 32 and leads 42 pass through holes in sheets 31 and 32, insulating layer 46 and wall 35 to extend outside housing 34.

Finally, secondary emitter 50 is placed over sheet 32 in housing 34. Pressure is applied to secondary emitter along each edge to compact the resulting laminate. Preferably, about 10 pounds of pressure is used. Then, clips 38 are installed. Clips 38 are secured to sidewalls 36 of housing 34, typically by rivets, and they overlie the edge of secondary emitter 50 to prevent secondary emitter from rising out of housing 34 to mechanically clamp the assembly in place. Then, the entire assembly is heated to a temperature and for a period of time to vaporize mesh sheet 60, as in the embodiment of FIGS. 1–4. Typically, the assembly is heated to a temperature of about 500° C. for about 60 minutes. Thereafter, connector 44 is attached to leads 42.

The panel emitter of the invention radiates infrared energy evenly and uniformly across its entire emitting surface 19. The temperature variation across the panel can be limited to 0.5° C. or less. The panel emits a broad band of radiation in the middle and far regions and thus readily penetrates and is absorbed by materials having a wide range of colors and atomic structures. Within that broad band the panel emits a peak wavelength which can be adjusted within the broad range by varying the temperature of the primary emitter for selective heating of selected materials and colors within a product load. The panel emitters can be used for solder attachment of surface mounted devices to printed circuit boards. One type of panel emitter has been designed for this use having a peak temperature rating of 800° C. which corresponds to a peak wavelength of 2.7.

A 12 inch square panel emitter of the invention converts 80 to 90% of all input energy to process energy. Typically, this panel draws only about 4.5 amps at start up and drops to 2.2 amps after warm-up. This panel is unaffected by occasional voltage variations often encountered in production environments. The life expectancy of the panels is typically 6,000 to 8,000 hours plus.

Although the invention has been described above by reference to several preferred embodiments, many additional modifications and variations thereof will now be apparent to those skilled in the art. Accordingly, the scope of the invention is to be limited not by the details of the illustrative embodiments described herein, but only by the terms of the appended claims and their equivalents.

I claim:

1. An infrared panel emitter having a peak temperature rating of at least about 800° C., said panel emitter comprising:

a metal foil having an etched pattern for emitting primary radiation;

two layers of paper, one layer being disposed on each side of said primary emitting means, said paper being stable at temperatures of at least 1000° C.;

an insulating layer disposed adjacent one of said paper layers; and a secondary emitting layer disposed adjacent the other of said paper layers, said secondary emitting layer comprising an electrically-insulating, high emissivity material having a secondary emitting surface which is disposed on a side opposite of said other paper layer, said secondary emitting layer absorbing radiation from said primary emitting means and emitting secondary infrared radiation at said secondary emitting surface.

2. The panel emitter of claim 1 wherein said paper layers are formed of aluminum oxide and silicon dioxide.

3. The panel emitter of claim 1 wherein said secondary emitting layer comprises a rigid, optically clear glass.

4. The panel emitter of claim 1 wherein said insulating layer is formed of compressed calcium chloride powder without a binder.

5. The panel emitter of claim 1 further comprising a metal housing enclosing said primary emitting means, said two paper layers, said insulating layer and said secondary emitting layer.

6. A method for producing an infrared panel emitter comprising the steps of:

placing an insulating layer into a metal housing;

laying a first layer of high temperature resistant paper over the insulating layer;

supporting a metal foil element having an etched pattern on a mesh sheet;

inserting the metal foil element and the mesh sheet into the housing adjacent the first layer of paper;

laying over the metal foil element and mesh sheet a second layer of high temperature resistant paper;

covering the assembly with a rigid, infrared transparent secondary infrared emitting layer;

compressing the layers of the assembly against one another;

heating the metal foil element to vaporize the mesh sheet;

cooling the metal foil to leave a void in place of the mesh sheet coextensive with the surface of the metal foil element; and locking the layers in position.

7. The method of claim 6 wherein about 10 pounds of force is used in said compressing step.

8. The method of claim 6 wherein said locking step comprises the step of securing clips to the housing, the slips overlying the edges of the secondary infrared emitter in unattached relation therewith.

9. The panel emitter of claim 1 further comprising a void coextensive with one entire lateral surface of said metal foil when said metal foil is in a normally unheated condition to permit thermal expansion of said metal foil.

10. The panel emitter of claim 1 further comprising temperature sensing means disposed between said secondary emitting layer and one of said layers of paper.

11. The panel emitter of claim 1 further comprising means for locking together said metal foil, said two layers of paper, said insulating layer and said secondary emitting layer without the use of adhesives, said locking means comprising a housing surrounding at least a portion of said insulating layer and means connecting said secondary emitting layer to said housing.

* * * * *